US010330375B2

(12) United States Patent
Lee

(10) Patent No.: US 10,330,375 B2
(45) Date of Patent: Jun. 25, 2019

(54) REFRIGERATOR

(71) Applicant: LG Electronics Inc., Seoul (KR)

(72) Inventor: Seungho Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/548,148

(22) PCT Filed: Jul. 7, 2016

(86) PCT No.: PCT/KR2016/007391
§ 371 (c)(1),
(2) Date: Aug. 2, 2017

(87) PCT Pub. No.: WO2017/010742
PCT Pub. Date: Jan. 19, 2017

(65) Prior Publication Data

US 2018/0266753 A1 Sep. 20, 2018

(30) Foreign Application Priority Data

Jul. 15, 2015 (KR) ..... 10-2015-0100630

(51) Int. Cl.
*F25D 25/02* (2006.01)
*F25D 27/00* (2006.01)
(Continued)

(52) U.S. Cl.
CPC ..... *F25D 25/02* (2013.01); *F25D 27/00* (2013.01); *H01H 1/24* (2013.01); *H01H 3/16* (2013.01);
(Continued)

(58) Field of Classification Search
CPC ..... F25D 25/02; F25D 25/024; F25D 27/00; F25D 27/005; F25D 2400/40;
(Continued)

(56) References Cited

U.S. PATENT DOCUMENTS 5,287,252 A * 2/1994 Caruso ..... F25D 25/02 312/223.5
5,695,261 A * 12/1997 Slesinger ..... A47F 11/10 312/223.6
(Continued)

FOREIGN PATENT DOCUMENTS

CN 103615862 3/2014
DE 19737157 3/1999
(Continued)

OTHER PUBLICATIONS

European Extended Search Report in European Application No. 16824659.3, dated Aug. 13, 2018, 8 pages.
(Continued)

*Primary Examiner* — Patrick D Hawn
(74) *Attorney, Agent, or Firm* — Fish & Richardson P.C.

(57) ABSTRACT

Disclosed is refrigerator including a holder terminal unit provided in a main body of the refrigerator; and a shelf terminal unit provided in a shelf installed in the main body, wherein the holder terminal unit includes a holder installed at an inner rear wall of the main body and having an opening which is opened toward a front side of the refrigerator; a holder side terminal provided to correspond to a shelf side terminal of the shelf terminal unit and movable in forward and backward directions within the holder; and an elastic member provided between the holder and the holder side terminal and configured to elastically support the holder side terminal, and wherein the holder side terminal is pressurized by the shelf side terminal which is inserted into the holder through the opening and moved backwardly, while maintaining an elastic contact with the shelf side terminal by the elastic member.

19 Claims, 14 Drawing Sheets

(51) Int. Cl.
*H01H 1/24* (2006.01)
*H01H 3/16* (2006.01)
*H01H 9/08* (2006.01)

(52) U.S. Cl.
CPC ..... *H01H 9/085* (2013.01); *F25D 2325/022* (2013.01); *F25D 2400/40* (2013.01)

(58) Field of Classification Search
CPC ..... F25D 2325/022; H01H 1/24; H01H 3/16; H01H 9/085
See application file for complete search history.

(56) References Cited

U.S. PATENT DOCUMENTS 6,464,526 B1 * 10/2002 Seufert ..... H01R 13/6273 439/352
7,163,305 B2 * 1/2007 Bienick ..... A47B 97/00 362/125
7,434,951 B2 * 10/2008 Bienick ..... A47B 97/00 362/133
7,748,806 B2 * 7/2010 Egan ..... A47B 96/02 108/102
8,322,873 B2 * 12/2012 Glovatsky ..... F25D 27/00 362/23.16
9,410,734 B2 * 8/2016 Shin ..... F25D 27/00
9,537,274 B1 * 1/2017 Dankelmann ..... H01R 25/142
9,581,383 B2 * 2/2017 Brown ..... F25D 27/00
9,601,881 B2 * 3/2017 Lee ..... F25D 23/028
9,766,010 B2 * 9/2017 Katu ..... F25D 27/00
9,793,763 B2 * 10/2017 Lee ..... H02J 50/12
2003/0038571 A1 * 2/2003 Obrock ..... C03B 23/033 312/408
2004/0264160 A1 * 12/2004 Bienick ..... A47B 97/00 362/602
2007/0046160 A1 * 3/2007 Egan ..... A47B 96/02 312/408
2007/0109764 A1 * 5/2007 Bienick ..... A47B 97/00 362/92
2008/0043456 A1 * 2/2008 Bernardini ..... A47B 57/42 362/94
2009/0302724 A1 * 12/2009 Allard ..... F25D 17/042 312/237
2010/0176703 A1 * 7/2010 Kim ..... F25D 25/02 312/408
2012/0106129 A1 * 5/2012 Glovatsky ..... F25D 27/00 362/92
2012/0140440 A1 * 6/2012 Dam ..... F21V 23/02 362/92
2012/0230018 A1 * 9/2012 Wiemer ..... A47F 5/103 362/133
2014/0224875 A1 * 8/2014 Slesinger ..... H01R 25/142 235/385
2014/0320040 A1 * 10/2014 Katu ..... F25D 27/00 315/292
2015/0023000 A1 * 1/2015 Kendall ..... F25D 25/02 362/92
2016/0134064 A1 * 5/2016 Lee ..... F25D 23/028 62/264
2016/0161669 A1 * 6/2016 Lee ..... F25D 25/02 362/621

FOREIGN PATENT DOCUMENTS

EP 2765379 8/2014
EP 2768085 8/2014
EP 2886021 6/2015
FR 2891446 4/2007
JP 2007128742 5/2007
KR 10-2006-0002529 1/2006
KR 20060002529 A * 1/2006 ..... H01R 13/2421
KR 10-2011-0045445 5/2011
KR 20110045445 A * 5/2011
KR 20-2013-0005935 10/2013
WO WO2009061415 5/2009

OTHER PUBLICATIONS

Chinese Office Action in Chinese Appln. No. 201680010813.6, dated Mar. 26, 2019, 12 pages (with English translation).

* cited by examiner

REFRIGERATOR

CROSS-REFERENCE TO RELATED APPLICATIONS

This application is a National Stage application under 35 U.S.C. § 371 of International Application No. PCT/KR2016/007391, filed Jul. 7, 2016, which claims the benefit of Korean Application No. 10-2015-0100630, filed on Jul. 15, 2015. The disclosures of the prior applications are incorporated by reference in their entirety.

TECHNICAL FIELD

The present disclosure relates to a refrigerator having a power supply module that supplies a power to electronic elements provided on a shelf.

BACKGROUND ART

A refrigerator is an apparatus which maintains freshness of various foodstuffs at a low temperature, using cooling air generated by a refrigeration cycle including a compressor, a condenser, an expansion valve and an evaporator.

The refrigerator includes at least one of a storage unit (for instance, a shelf, a tray, a basket, and the like) to effectively use an internal storage space. For instance, the shelf and tray may be installed within a main body of the refrigerator, and the basket may be disposed at an inside of a door.

Meanwhile, the refrigerator may include a lighting installation to illuminate an inside of the refrigerator and a display device to display information. Recently, a research on a power supply structure has been made for a lighting of the shelf, for a user's convenience and in a viewpoint of esthetic appreciation.

However, in case of a drawer type shelf which is installed to be drawn into an inside of the refrigerator from outside, a general power supply structure which uses a cable has a difficulty in assembling. Further, a sealing of the power supply structure is a very important factor from the viewpoint of the humid environment inside the refrigerator.

DISCLOSURE

Technical Problem

Therefore, an aspect of the detailed description is to provide a refrigerator with a structure to improve a transfer of impact to a holder side terminal due to assembly dispersion or dimension dispersion when assembling a shelf.

Another aspect of the detailed description is to provide a refrigerator with a structure to limit the holder side terminal and the shelf side terminal to be exposed to moisture.

Still another aspect of the detailed description is to provide a refrigerator with a structure to prevent a movement failure of the holder side terminal by an eccentric pressure from being generated when inserting the shelf side terminal into one side of the holder side terminal.

Still another aspect of the detailed description is to provide a refrigerator with a structure to improve the problem in that an electric connection between the power supply and the holder side terminal is hindered since the natural resistance of an elastic member is high when applying a power through the elastic member.

Still another aspect of the detailed description is to provide a refrigerator with a structure to set an internal movement range of the holder side terminal by a pressure of the shelf side terminal.

Technical Solution

To achieve these and other advantages and in accordance with the purpose of the present disclosure, as embodied and broadly described herein, there is provided a holder terminal unit provided in a main body of the refrigerator; and a shelf terminal unit provided in a shelf installed in the main body, wherein the holder terminal unit may include a holder installed at an inner rear wall of the main body and having an opening which is opened toward a front side of the refrigerator; a holder side terminal provided to correspond to a shelf side terminal of the shelf terminal unit and configured to be movable in the forward and backward directions within the holder; and an elastic member provided between the holder and the holder side terminal and configured to elastically support the holder side terminal, and the holder side terminal is pressurized by the shelf side terminal which is inserted through the opening into the holder and moved backwardly, while maintaining an elastic contact with the shelf side terminal by the elastic member.

In one embodiment disclosed herein, the holder terminal unit may be provided at the inner rear wall of the main body so that the holder side terminal may be located in a front side, and the shelf side terminal may be provided at a rear side of the shelf which faces the rear wall so as to face the holder side terminal with each other.

In one embodiment disclosed herein, a pair of guide ribs may be extended in the front and rear directions at both inner sides of the holder, and the holder side terminal may be accommodated between the guide ribs so as to be guided in the front and rear directions.

In one embodiment disclosed herein, the holder terminal unit may be mounted to the holder so as to cover the opening, and may further include a cover having a cutout portion through which the shelf side terminal passes.

In one embodiment disclosed herein, the cutout portion may include a main cutout portion which is cutout vertically in a lengthwise direction of the cover, and a first sub-cutout portion and a second sub-cutout portion each provided at both ends of the main cutout portion and extended toward both sides of the main cutout portion.

In one embodiment disclosed herein, the cover may be formed of an elastically transformable material.

In one embodiment disclosed herein, the holder terminal unit may further include a bridge configured to elastically support both sides of a rear surface of the holder side terminal to compensate for an eccentric pressure generated by pressing one side of the holder side terminal.

In one embodiment disclosed herein, the bridge may be formed of a metallic material and configured to electrically connect the power supply to the holder side terminal.

In one embodiment disclosed herein, the bridge may include a support part extended from a rear surface of the holder side terminal in a lengthwise direction and configured to support both sides of the holder side terminal, and a connection part extended to cross the lengthwise direction and elastically supported by the holder, and electrically connected to the power supply unit.

In one embodiment disclosed herein, the connection part may be extended from a central portion of the support part.

In one embodiment disclosed herein, the support part may be formed to have a shape bent a plurality of times to support both ends of the holder side terminal without contacting a central portion of the holder side terminal.

In one embodiment disclosed herein, the elastic member may be disposed at a central portion of the support part.

In one embodiment disclosed herein, the shelf side terminal may include a first shelf side terminal and a second shelf side terminal in upper and lower directions thereof, respectively, and the holder side terminal may include a first holder side terminal corresponding to the first shelf side terminal and a second holder side terminal corresponding to the second shelf side holder.

In one embodiment disclosed herein, the holder may include an insulation jaw disposed between the first holder side terminal and the second holder side terminal for insulation therebetween.

In one embodiment disclosed herein, the shelf terminal unit may further include a shelf terminal housing, disposed at a rear side of the shelf, to which the first and second shelf side terminals are mounted, respectively, and the shelf terminal housing may be hooked by the insulation jaw when the shelf is inserted into the main body more than a predetermined depth.

In one embodiment disclosed herein, the bridge may include a first bridge corresponding to the first holder side terminal provided at an upper side, and a second bridge corresponding to the second holder side terminal provided at a lower side, and the connection part of the first bridge may be upwardly extended, and the connection part of the second bridge may be downwardly extended.

In one embodiment disclosed herein, the holder terminal unit may further include a bridge extended in a lengthwise direction on a rear surface of the holder side terminal and including a support part configured to support both sides of the holder side terminal, and a connection part extended to cross the lengthwise direction from the support part so as to be elastically supported by the holder and electrically connected to the power supply unit. The bridge may include a first bridge corresponding to the first holder side terminal provided at an upper side, and a second bridge corresponding to the second holder side terminal provided at a lower side, and the connection part of the first bridge may be upwardly extended, and the connection part of the second bridge may be downwardly extended.

In one embodiment disclosed herein, the elastic member may include a first spring and a second spring disposed at both sides of the holder side terminal, respectively.

In one embodiment disclosed herein, the holder terminal unit may further include a power supply terminal electrically connected to the power supply unit, and a connection member connected to the power supply terminal and configured to elastically support a rear surface of the holder side terminal, and formed of a metallic material to electrically connect the power supply terminal to the holder side terminal.

In one embodiment disclosed herein, the elastic member may be connected to one end of the connection member which elastically supports a rear surface of the holder side terminal and the power supply terminal, respectively.

Further, in one embodiment, there may be provided at the shelf a light source configured to emit a light by receiving a power when the shelf side terminal and the holder side terminal are electrically connected with each other, and a light guide member that guides a light emitted from the light source.

Advantageous Effects

According to the present disclosure, the holder side terminal is configured to be inwardly and outwardly movable, and an elastic member is provided at a rear surface of the holder side terminal. Such a configuration enables the holder side terminal to move inwardly in an elastically supported state, so that a shock that may be generated at the holder side terminal when assembling a shelf can be buffered. Further, since the holder side terminal is configured to be in contact with the shelf side terminal with pressure by the elastic member, the contact reliability can be enhanced.

Further, since a cover including a cutout portion through which the shelf side terminal may pass is mounted at the holder, inflow of moisture can be limited, thus protecting the holder side terminal and the shelf side terminal, thereby enhancing the contact reliability.

Additionally, a bridge is provided at a rear surface of the holder side terminal to elastically support both sides of the rear surface of the holder. According to this configuration, an eccentric pressure that may be generated by pressing one side of the holder side terminal can be compensated, so that a movement failure due to the eccentric pressure can be prevented.

The bridge for correcting the eccentricity of the holder side terminal may be used as a medium for an electric connection between the power supply unit and the holder side terminal. In this instance, the problem in that a disturbance in the electric connection between the power supply unit and the holder side terminal occurs since the natural resistance of the elastic member is high when supplying a power through the elastic member, can be improved.

Further, the shelf terminal housing of the shelf terminal unit is configured to be hooked by an insulation jaw when inserted into the holder at a predetermined depth. Thus, an insertion depth of the shelf terminal unit into the holder can be limited, and a damage of the holder terminal unit due to an excessive insertion of the shelf terminal unit can be prevented.

Meanwhile, a first spring and a second spring are disposed at both sides of the holder side terminal to elastically support both ends of the holder side terminal. Thus, it is possible to compensate for an eccentric pressure without the bridge as described above.

Additionally, the connection member may be configured to elastically support a rear surface of the holder side terminal while electrically connecting the power supply terminal to the holder side terminal. Thus, an eccentricity at a predetermined level can be compensated, and a smooth electric current flow can be made when the connection member is used as a medium for an electric connection between the power supply terminal and the holder side terminal.

MODE FOR INVENTION

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated.

The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

A singular representation may include a plural representation unless it represents a definitely different meaning from the context. Further, it will be understood that although the terms first, second, etc. may be used herein to describe various elements, these elements should not be limited by these terms. These terms are generally only used to distinguish one element from another.

Figure 1:
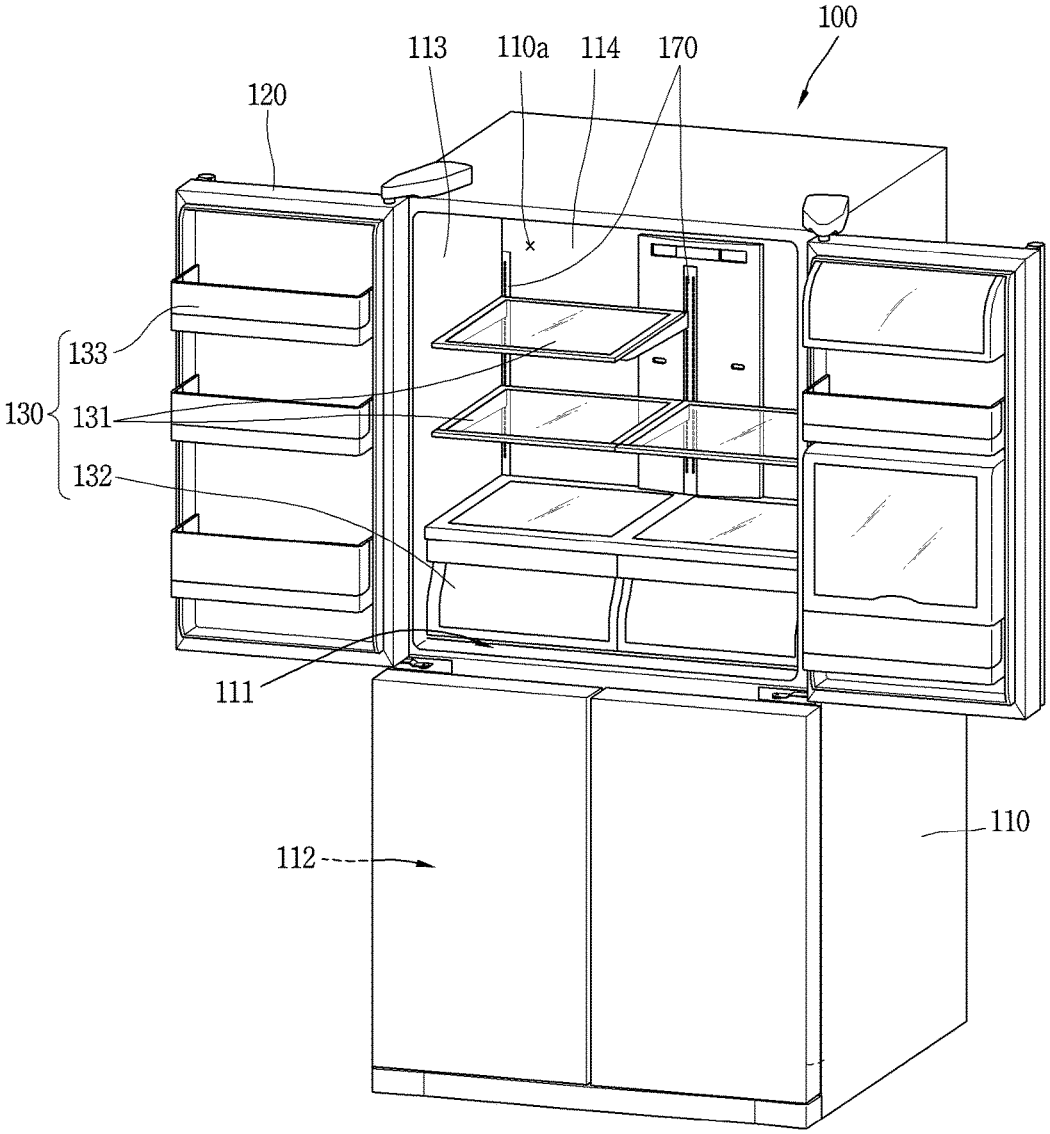
FIG. 1 is a conceptual view illustrating a refrigerator according to an embodiment of the present disclosure.
Figure 2:
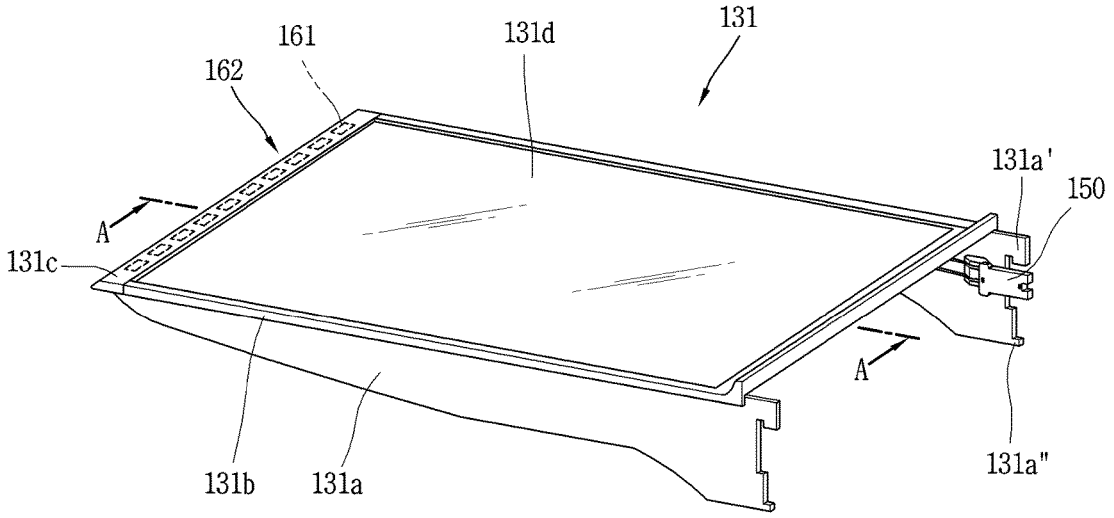
FIG. 2 is a conceptual view illustrating a shelf of the refrigerator of FIG. 1.
Figure 3:
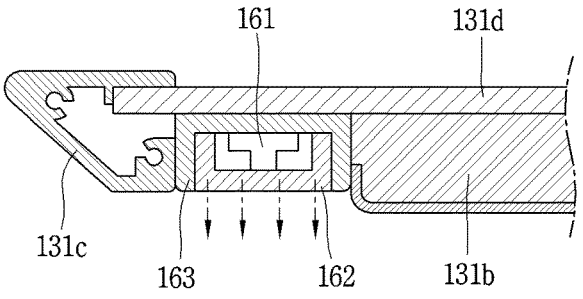
FIG. 3 is a cross-sectional view taken along the line A-A of FIG. 2.

FIG. 1 is a conceptual view illustrating a refrigerator according to an embodiment of the present disclosure, FIG. 2 is a conceptual view illustrating a shelf of the refrigerator of FIG. 1, and FIG. 3 is a cross-sectional view taken along the line A-A of FIG. 2 FIG.

Referring to FIG. 1, a refrigerator main body 110 includes a storage space for storing foodstuffs therein. The storage space may be divided into a refrigerating chamber 111 and a freezing chamber 112 according to a set temperature.

In this embodiment, though a bottom freezer type refrigerator in which the refrigerating chamber 111 is disposed at an upper portion and the freezing chamber 112 is disposed at a lower portion, the present disclosure is not limited thereto. The present disclosure may be applied to a side by side type refrigerator in which the refrigerating chamber and the freezing chamber are disposed at left and right sides and a top mount type refrigerator in which the freezing chamber is disposed above the refrigerating chamber.

A door 120 is coupled to a refrigerator main body 110 so that a front opening 110*a* of the refrigerator main body 110 may be opened or closed. The door 120 may be embodied in various types, that is, a revolving type in which the door 120 is rotatably coupled to the refrigerator main body 110, and a drawer type in which the door 120 is coupled to the refrigerator main body 110 in a slide movable manner.

The refrigerator 100 includes at least one accommodation unit 130 (for instance, a shelf 131, a tray 132, a basket 133, and the like) for efficient use of the storage space. For instance, the shelf 131 and the tray 132 may be disposed within the refrigerator main body 110, and the basket 133 may be disposed at an inside of the door 120 coupled to the refrigerator main body 110.

The shelf 131 is formed in a plate shape and disposed horizontally within the refrigerator main body 110 so that food stuffs may be put thereon. The shelf 131 can be fixed to a frame 170 installed on an inner rear wall 114 by being hooked thereto.

The tray 132 forms a space which is divided by other storage spaces within the refrigerator 100 so that foodstuffs may be stored thereon. The tray 132 may be supported on an inner bottom surface of the refrigerator main body 110 and may be moved in a slide manner on the bottom surface when installing.

Hereinafter, the shelf 131 will be described more specifically.

Referring to FIGS. 2 and 3, the shelf 131 includes shelf frames 131*a*, 131*b* and 131*c*, and an upper plate 131*d*.

The shelf frames 131*a*, 131*b* and 131*c* form a basic framework of the shelf 131 and configured to be installed to the refrigerator main body 110. The shelf frames 131*a*, 131*b* and 131*c* are configured by a combination of a plurality of shelf frames. Each of the shelf frames 131*a*, 131*b* and 131*c* may be formed of a metallic material of high strength or a synthetic resin material.

In this embodiment, it is exemplified shown that the shelf frames 131*a*, 131*b* and 131*c* are configured to include a side bracket 131*a*, an upper frame 131*b* and a cover frame 131*c*.

The side bracket 131*a* is provided at both sides of the shelf 131 and formed to extend in the lengthwise direction of the shelf 131. The side bracket 131*a* is formed to be hooked and fixed to the frame 170 disposed at an inner rear wall 114 of the refrigerator main body 110, and for this purpose, may include a hook part 131*a*' and an insertion part 131*a*". The structure to install the shelf 131 to the refrigerator main body 110 will be described in detail later.

The upper frame 131*b* is coupled to the side brackets 131*a* at both sides of the shelf 131, respectively, to provide an installation space onto which the upper plate 131*d* is covered. For this purpose, the upper frame 131*b* may be formed in a loop type having an opening corresponding to the installation space.

The upper plate 131*d* is disposed on the upper frame 131*b* so that foodstuffs can be placed thereon. The upper plate 131*d* may be formed of a transmissive material (for instance, a reinforced plastic, a tempered glass, or the like), and in this instance, the upper frame 131*b* may be fabricated to support a rib portion of the upper plate 131*d*.

The cover frame 131*c* is coupled to a front side of the shelf 131 to make clear an appearance of the front side which may be exposed to a user.

Meanwhile, an electric connection to electronic devices provided at the shelf 131 may be required. However, in case of the shelf 131 which is installed by being inserted from the outside to the inside of the refrigerator 100, a general power supply structure using a cable has a difficulty in the assembling work. Further, due to the humid environment inside the refrigerator 100, a sealing is very important factor of the power supply structure.

Hereinafter, considering an installation method of the shelf 131 and the internal environment of the refrigerator 100, a power supply structure of a lighting apparatus 160 disposed at the shelf 131 will be described as an example of a power supply structure which enables an easy electric connection between the refrigerator main body 110 and the shelf 131.

A lighting apparatus 160 which illuminates the shelf 131 may be provided at the shelf 131. In this embodiment, a configuration that the lighting apparatus 160 is disposed at a front side of the shelf 131 to illuminate a light downwardly is exemplified shown, but not limited thereto. The lighting apparatus 160 may be configured to illuminate one region or the whole region of the shelf 131.

The lighting apparatus 160 includes a light source 161 and a light guide member 162 which are disposed at the shelf 131 to illuminate at least one part of the shelf 131.

The light source 161 is configured to emit a light by receiving a power. A high brightness LED may be used as the light source 161. In this embodiment, the light source 161 is provided in plural and disposed to be spaced apart from each other on a front end portion of the shelf 131 along the width at a preset interval.

The light guide member 162 is configured to guide a light emitted from the light source 161. To this end, the light guide member 162 may be formed of a transmissive material. The light guide member 162 may be extended along a width at a front end portion of the shelf 131.

Referring to FIG. 3, the light source 161 may be installed to a rear surface of a front end of the upper plate 131*d*, and the light guide member 162 may be installed to a rear surface of a front end of the upper plate 131*d* to cover the light source 161.

A shield member 163 may be attached to a rear surface at a front end of the upper plate 131*d* to cover the light source 161 and the light guide member 162 when seeing from outside except a bottom surface. Further, a light may be directed toward a lower side of the shelf 131 by the shield member 163.

Meanwhile, a shelf terminal unit 150 is provided to the shelf 131 to supply a power to the lighting apparatus 160 disposed at the shelf 131.

The shelf terminal unit 150 is electrically connected with the lighting apparatus 160 (exactly, a light source 161 which needs a power supply), and the shelf 131 is configured to be electrically connected with a holder terminal unit 140 when installing the shelf 131 to the refrigerator main body 110. As shown, the shelf terminal unit 150 may be disposed at at least a rear end of the one side bracket 131*a*, and electrically connected to the lighting apparatus 160 through a cable.

Figure 4:
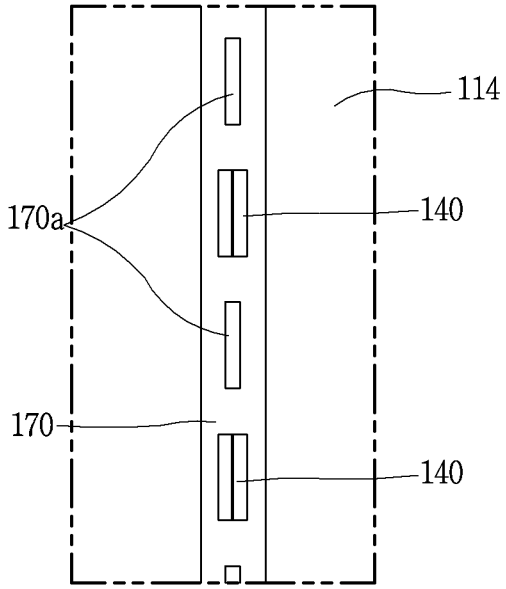
FIG. 4 is a conceptual view illustrating an inner rear wall of the refrigerator main body of FIG. 1.

FIG. 4 is a conceptual view illustrating an inner rear wall 114 of the refrigerator main body 110 of FIG. 1.

Referring to FIG. 4, a frame 170 is disposed at an inner rear wall 114 of the refrigerator main body 110 corresponding to the shelf terminal unit 150. The frame 170 is formed to be extended upwardly and downwardly, and a plurality of openings 170*a* is formed in the extended lengthwise direction at a preset interval.

The shelf 131 is mounted to the frame 170 so as to be fixed at its position. The hook part 131*a*' of the side bracket 131*a*, as described above, is configured to be inserted into and hooked by an opening 170*a* of the frame 170, and an insertion part 131*a*" is configured to be inserted into another opening 170*a*.

Meanwhile, a holder terminal unit 140 is provided between the opening 170*a* in which the hook part 131*a*' is inserted and the opening 170*a* in which the insertion part 131*a*" is inserted so that the shelf terminal unit 150 is connected to the holder terminal unit 140 when mounting the shelf 131 to the frame 170.

The opening 170*a* in which the hook part 131*a*' is inserted, the holder terminal unit 140 (the opening 141' is covered by a cover 144) in which the shelf terminal unit 150 is inserted, and the opening 170*a* in which the insertion part 131*a*" is inserted are sequentially disposed on the frame 170 in the upper and lower directions, and they may be provided at positions where the shelf 131 may be mounted.

In this instance, the opening 170*a* in which the hook part 131*a*' is inserted and the opening 170*a* in which the insertion part 131*a*" is inserted may be used in common. Thus, as shown, the opening 170*a* and the holder terminal unit 140 may be provided repeatedly in order.

Figure 5:
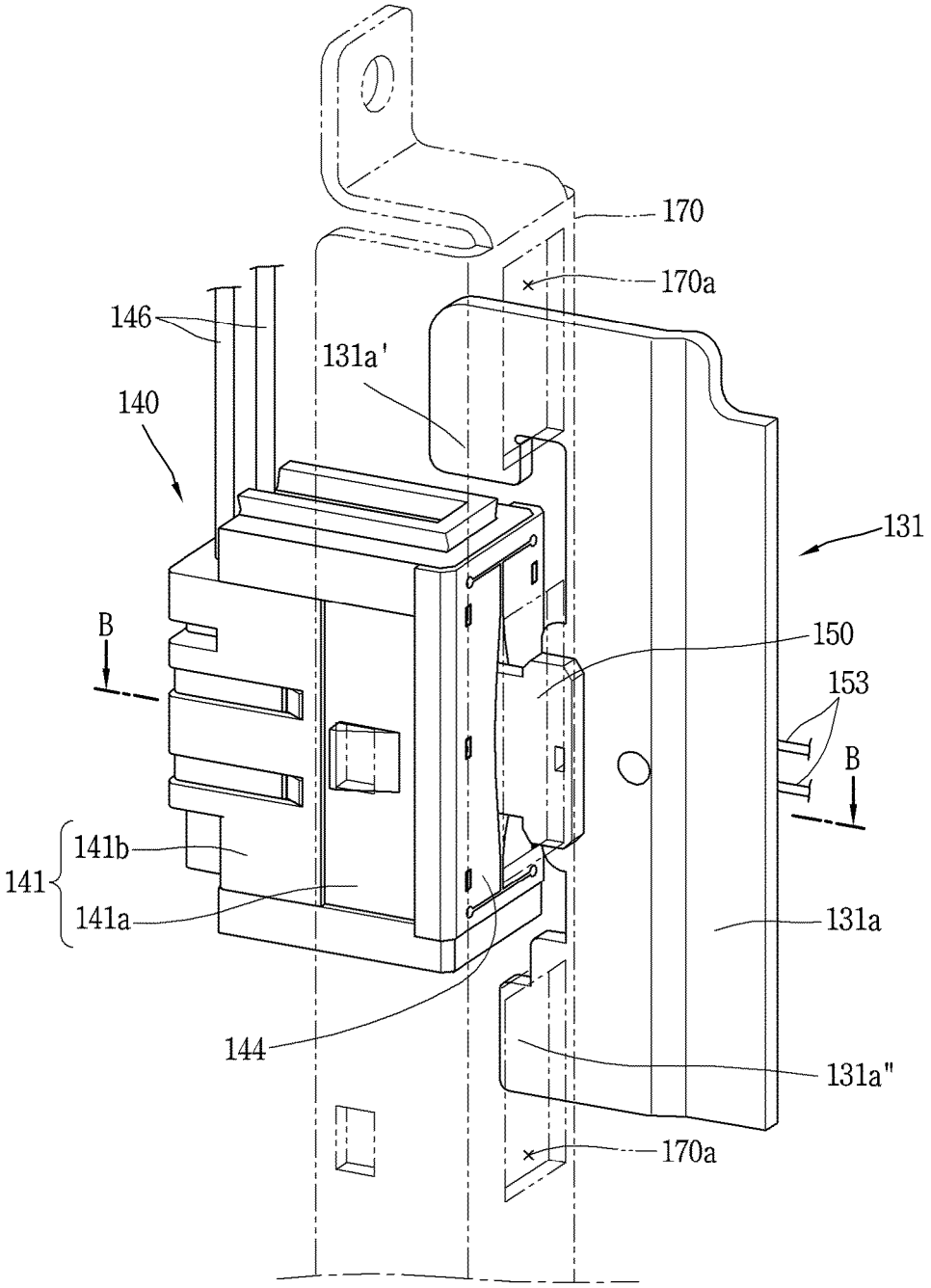
FIGS. 5 and 6 are conceptual views illustrating a power supply module according to an embodiment of the present disclosure, showing a connection state of a shelf terminal unit and a holder terminal unit.
Figure 6:
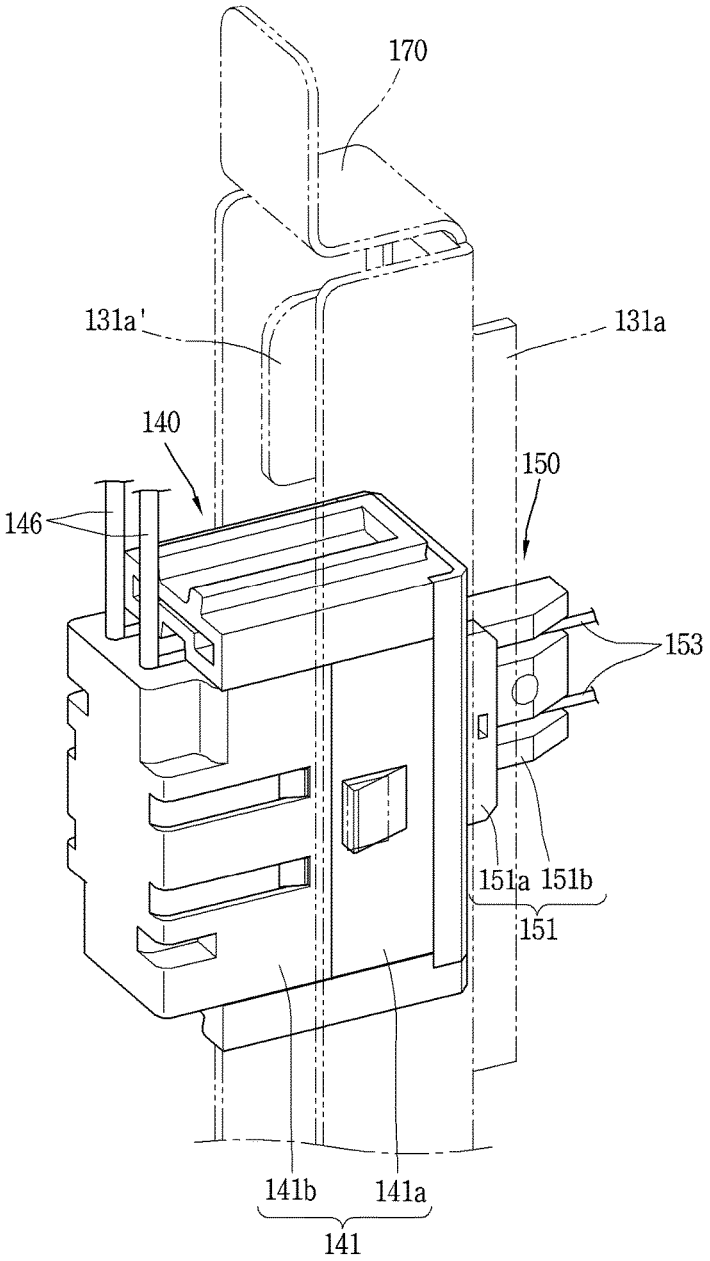

FIGS. 5 and 6 are conceptual views illustrating a power supply module according to an embodiment of the present disclosure, showing the connection state of the shelf terminal unit 150 and the holder terminal unit 140.

Referring to the above drawings, a power supply module is provided to at least one structural element of the shelf 131 which needs to be connected to a power source. Hereinafter, as the structure which needs to be connected to a power source, the light source 161 will be described as an example.

The power supply module includes a holder terminal unit 140 provided at the refrigerator main body 110 and a shelf terminal unit 150 provided at the shelf 131 which is detachably disposed at the refrigerator main body 110.

The holder terminal unit 140 is electrically connected to the power supply unit and configured to be connected to the shelf terminal unit 150 when the shelf 131 is installed to the refrigerator main body 110. Thus, when the shelf 131 is installed to the refrigerator main body 110, a power is supplied to the light source 161 by a connection between the holder terminal unit 140 and the shelf terminal unit 150.

Meanwhile, the installation position (height) of the shelf 131 may be variously changed as user's needs. To this end, a plurality of openings 170*a* is provided at the frame 170 in the extended lengthwise direction at a preset interval, and a hook part 131*a*' configured to be inserted into one of the plural openings 170*a* and hooked to the frame 170 is provided at an upper part of the shelf 131. An insertion part 131*a*" is provided at a lower portion of the shelf 131 so as to be inserted into another opening among the plural openings 170*a*.

Considering such an installation structure of the shelf 131, the holder terminal unit 140 is provided in plural to correspond to preset positions where the shelf 131 may be installed so that a power supply to the light source 161 can be made even though the shelf 131 is installed on any position. For instance, as shown in FIG. 4, the holder terminal unit 140 may be installed between the plural openings 170*a* of the frame 170.

The shelf terminal unit 150 is provided at a rear side of the shelf 131 so as to be connected to the holder terminal unit 140 when the shelf 131 is installed within the refrigerator main body 110. As will be described later, when the shelf 131 is installed within the refrigerator main body 110, the shelf terminal unit 150 is in contact with and electrically connected to the holder terminal unit 140.

That is, when the shelf 131 is moved to the inner rear wall 114 of the refrigerator main body 110 and installation is completed, a connection between the holder terminal unit 140 and the shelf terminal unit 150 can be made simultaneously. Accordingly, since a separate process for connection of a power source is not necessary except installation of the shelf 131, an assembling convenience can be enhanced.

Meanwhile, a cable 146 for an electrical connection between the holder side terminal 142 (refer to FIG. 8) and the power supply unit is connected to the holder terminal unit 140. The cable 146 may be electrically connected to a bridge 145 (refer to FIG. 8) which will be described later. For instance, the cable 146 may be coupled to a forcible contacting blade of the bridge 145 in a forcible contacting manner, and a holder cover 141*b* may be coupled to a holder body 141*a* so as to cover the cable 146 coupled to the bridge 145.

The cable 146 may include two cables 146 which may be connected to a (+) terminal and a (−) terminal of each bridge 145, respectively. In this instance, each bridge 145 may be disposed to be spaced apart from each other in a widthwise direction of the holder terminal unit 140 so that the two cables 146 may be connected in upper and lower directions of the frame 170, respectively, without any interference with each other.

Hereinafter, the shelf terminal unit 150 and the holder terminal unit 140 which constitute the power supply module will be described in detail.

Figure 7:
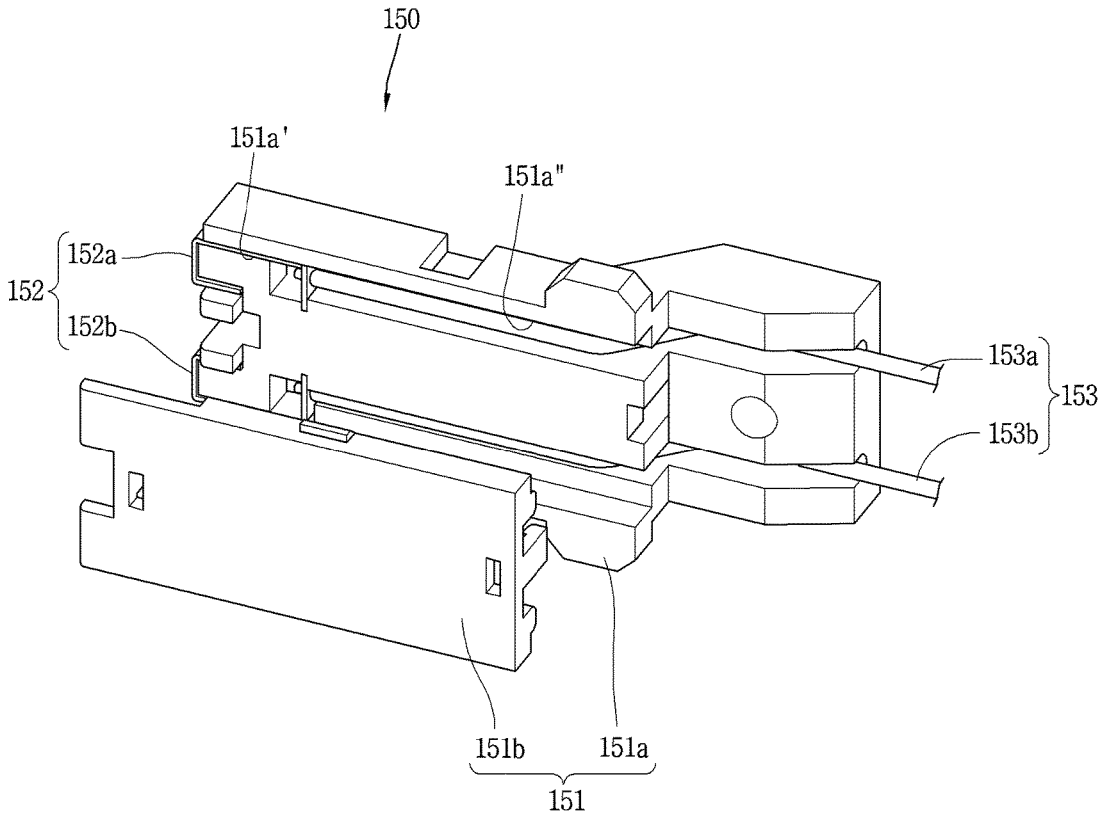
FIG. 7 is a disassembled perspective view of the shelf terminal unit of FIG. 5.

FIG. 7 is a disassembled perspective view of the shelf terminal unit 150 of FIG. 5.

Referring to FIG. 7, the shelf terminal unit 150 is electrically connected to the light source 161. The shelf terminal unit 150 is configured to be connected to the holder terminal unit 140 when the shelf terminal unit 150 is installed within the refrigerator main body 110, so that the light source 161 is electrically connected to the power source.

The shelf terminal unit 150 includes a shelf terminal housing 151, a shelf side terminal 152 and a cable 153.

The shelf terminal housing 151 is disposed at a rear side of the shelf 131, and may have a configuration to protrude from one rear end of the side bracket 131*a*, as shown in FIG. 3. Preferably, the shelf terminal housing 151 is formed of a synthetic resin material.

The shelf terminal housing 151 may include a shelf terminal body 151*a* and a shelf terminal cover 151*b*. The shelf terminal body 151*a* is provided with a terminal accommodation recess 151*a*' in which the shelf side terminal 152 is installed and a cable accommodation recess 151*a*" in which the cable 153 is installed, respectively. The shelf terminal cover 151*b* is coupled to the shelf terminal body 151*a* to cover the shelf side terminal 152 and the cable 153 which are accommodated in the terminal accommodation recess 151*a*' and the cable accommodation recess 151*a*", respectively.

The shelf side terminal 152 is installed in the terminal accommodation recess 151*a*' and part thereof is exposed to outside of the terminal housing 151. In the drawing, it is exemplified shown that the shelf side terminal 151 includes a first shelf side terminal 152*a* and a second shelf side terminal 152*b* at its upper and lower sides, respectively. Here, the first and second shelf side terminals 152*a* and 152*b* may constitute a (+) terminal and a (−) terminal, or vice versa.

The cable 153 is configured to electrically connect the shelf side terminal 152 to the light source 161. In the drawings, it is exemplified shown that the cable 153 includes a first cable 153*a* and a second cable 153*b* which correspond to the first shelf side terminal 152*a* and the second shelf side terminal 152*b*, respectively.

Hereinafter, the holder terminal unit 140 which is configured to be electrically connected to the shelf terminal unit 150 will be described.

Figure 8:
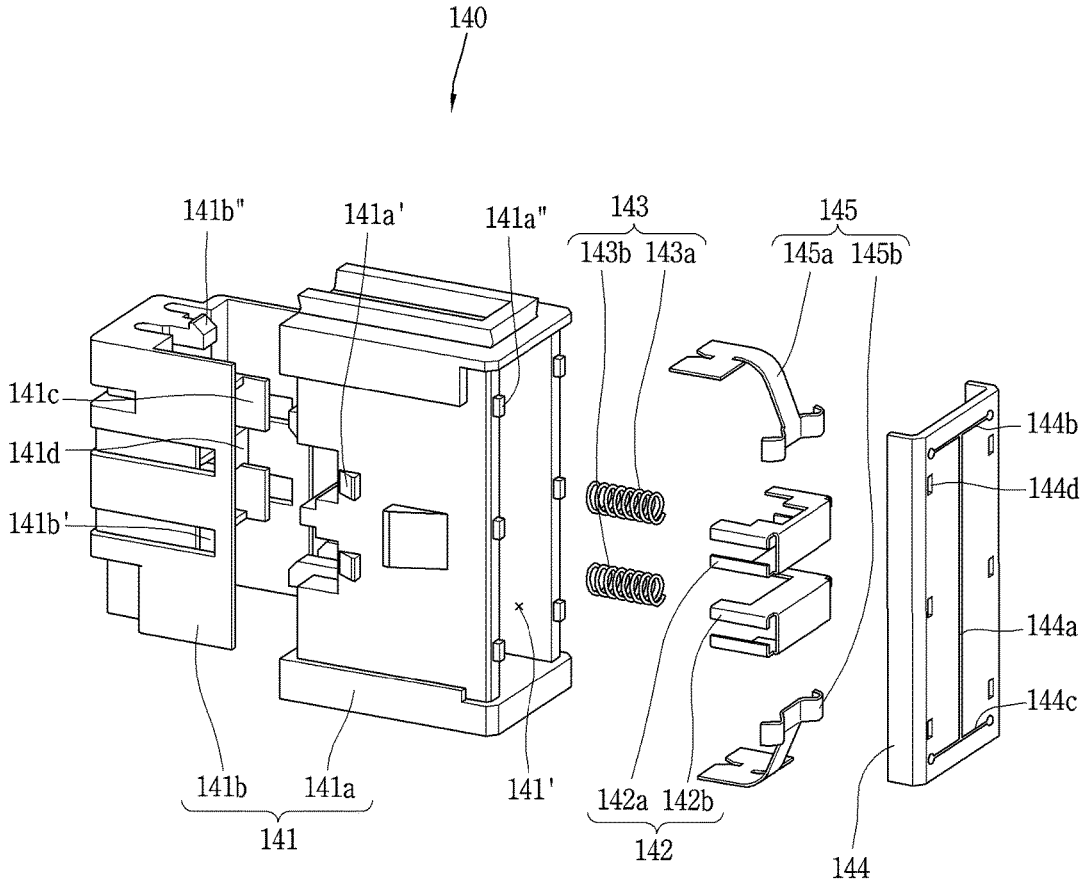
FIG. 8 is a disassembled perspective view of the holder terminal unit of FIG. 5.
Figure 9:
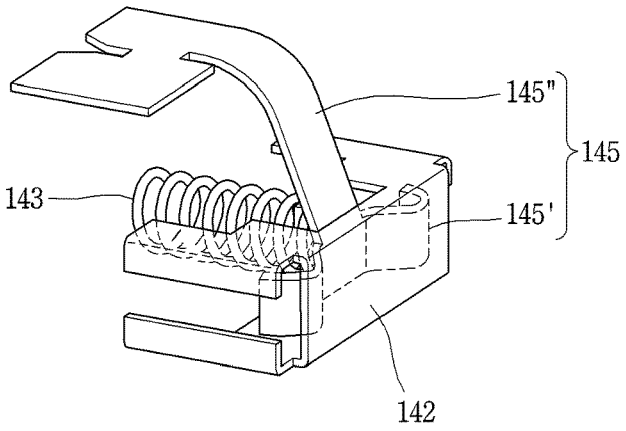
FIG. 9 is a conceptual view illustrating main elements of the holder terminal unit of FIG. 5.

FIG. 8 is a disassembled perspective view of the holder terminal unit 140 of FIG. 5, and FIG. 9 is a conceptual view illustrating main elements of the holder terminal unit 140 of FIG. 5.

Referring to FIGS. 8 and 9, the holder terminal unit 140 is configured to be electrically connected to the power supply and to the shelf 131 when installation of the shelf 131 within the refrigerator main body 110 is completed.

The holder terminal unit 140 includes a holder 141, a holder side terminal 142, an elastic member 143, a cover 144 and a bridge 145.

The holder 141 is installed to a frame 170 which is provided on an inner rear wall 114 of the refrigerator main body 110, and includes an opening 141' which is opened toward a front of the refrigerator 100. Here, the remaining portion of the holder 141 except a front portion corresponding to the opening 141' may be accommodated within the frame 170 or disposed at a rear surface of the frame 170 so that the cover 144 which covers the opening 141' may be exposed to outside toward a front side.

As described hereinbefore, the holder 141 may be provided to correspond to each preset position where the shelf 131 may be installed so that a power may be supplied to the light source 161 even though the shelf 131 is installed on any position. For instance, the holder 141 may be disposed to be spaced apart from each other at a predetermined interval in upper and lower lengthwise directions of the refrigerator main body 110.

The holder 141 may include a holder body 141*a* and a holder cover 141*b*. The holder 141 is preferably formed of a synthetic resin material.

The holder body 141*a* and the holder cover 141*b* may be formed in various types. In the drawings, it is shown that the holder body 141*a* is formed to have opened front and rear sides, and the holder cover 141*b* is coupled to cover a rear opening of the holder body 141*a*. For coupling the holder body 131*a* and the holder cover 141*b*, the holder body 131*a* and the holder cover 141*b* may be provided with hooks 141*a*' and 141*b*" and a hook recess 141*a*" or 141*b*'.

In the above configurations, the holder side terminal 142, the elastic member 143 and the bridge 145 are accommodated within the holder body 141*a*. The holder cover 141*b* is mounted to the holder body 141*a*, and configured to support and fix the holder side terminal 142, the elastic member 143 and the bridge 145 accommodated within the holder body 141*a* so as not to be pushed backward.

The holder side terminal 142 is electrically connected to the power supply and provided to correspond to the shelf side terminal 152. Specifically, the holder side terminal 142 is disposed to face the shelf side terminal 152 towards a front side of the refrigerator 100.

The holder side terminal 142 is configured to be movable to inner or outer side, that is, draw near or grow distant to the opponent shelf side terminal 152. The holder side terminal 142 may be formed by bending a metallic member in plural times. In the drawings, it is exemplified shown that the holder side terminal 142 is formed in "⊏" shape, viewing from an upper side.

Meanwhile, the shelf 131 is formed to have a width corresponding to a distance between both inner side walls of the refrigerator main body 110, but it is preferable that the width of the shelf 131 is shorter than a distance between both inner side walls of the refrigerator main body 110, to facilitate an easy installation. In this instance, the shelf 131 may have some movements in the left and right directions in the installation procedure of the shelf 131, and it means that a movement in the left and right directions may also exist in the shelf side terminal 152. The holder side terminal 142 is formed to have a shape long in left and right directions, considering such assembling dispersion and dimension dispersion.

The holder 141 may be provided with a guide rib 141*c* which is extended in a movement direction of the holder side terminal 142 to guide inner and outer movements of the holder side terminal 142. In the drawings, it is exemplified shown that the guide rib 141*c* is extended on the holder cover 141*b* toward the front, and a holder side terminal 142 is accommodated within the guide rib 141*c*. According to the above configuration, the holder side terminal 142 is configured to slidably move along the guide rib 141*c*, thus its movement is limited to one direction.

An elastic member 143 is provided at a rear surface of the holder side terminal 142 to elastically support the holder side terminal 142. Thus, the holder side terminal 142 may contact the shelf side terminal 152 with a pressure when the shelf 131 is installed to the refrigerator main body 110.

In this embodiment, it is exemplified shown that the elastic member 143 is configured by a compression spring, but not limited thereto. The elastic member 143 may be configured by any member which has an elasticity, like a leaf spring or a rubber.

As an example of the support structure of the elastic member 143, the elastic member 143 may be supported by an inner wall of the holder 141 and the bridge 145, respectively. Further, the holder cover 141*b* may include an elastic member accommodation part 141*e* (refer to FIGS. 10 and 11) for accommodating one end of the elastic member 143.

For reference, as another example of the support structure of the elastic member 143, the elastic member 143 may be supported by an inner wall of the holder 141 and a rear surface of the holder side terminal 142, respectively.

Meanwhile, due to a humid environment inside the refrigerator 100, the power supply module provided in the refrigerator 100 may be exposed to moisture. When a frost is formed on the power supply module due to the moisture, a problem in the reliability of the electrical connection between the shelf side terminal 152 and the holder side terminal 142 may occur.

Considering this, a cover 144 is mounted to the holder 141 to cover the front opening 141'. In FIG. 8, there is shown that a hook 141*a*" is formed on the holder body 141*a* and a hook recess 144*d* in which the hook 141*a*" is inserted is formed on the cover 144, for a coupling between the holder 141 and the cover 144.

The cover 144 is configured to limit introduction of moisture into the holder 141, and provides cutout portions 144*a*, 144*b* and 144*c* through which the shelf side terminal 152 may pass.

That is, since at least part of the shelf side terminal 150 is inserted into the holder 141 through the cutout portions 144*a*, 144*b* and 144*c*, and most part of the front opening 141' of the holder 141 is covered by the cover 144 through the cutout portions 144*a*, 144*b* and 144*c*, introduction of moisture is limited.

The cover 144 is preferably formed of an elastically deformable material (for instance, rubber, silicon, and the like). In this case, the cover 144 may be pushed in so as to be in contact with the shelf terminal unit 150 with pressure when inserting the shelf terminal unit 150.

The cutout portions may be divided by a main cutout portion 141*a*, a first cutout portion 141*b* and a second cutout portion 141*c*, as shown.

Specifically, the main cutout portion 141*a* is formed to be cut upward and downward in a lengthwise direction of the cover 144, and the first and second cutout portions 144*b* and 144*c* are extended at both ends of the main cutout portion 144*a* in the left and right directions of the main cutout portion 144*a*.

According to the above configuration, though the shelf terminal unit 150 is inserted to slant to one side based on the main cutout portion 144*a* and the one side is pushed in, the other side still covers the opening 141' so that introduction of moisture may be limited at a certain level.

As another example of the cutout portions 144*a*, 144*b* and 144*c*, on the contrary to the above example, the main cutout portion 144*a* is formed to be cut in the widthwise direction of the cover 144 at left and right sides, and the first and second sub cutout portions 144*b* and 144*c* are provided at both ends of the main cutout portion 144*a* and extended to both the upper and lower sides of the main cutout portion 144*a*.

Meanwhile, the holder side terminal 142 is formed to have a shape long in left and right directions, considering the assembling dispersion, as described above. When the shelf terminal 150 is inserted into the holder side terminal 142 as a slanted state toward one side of the holder side terminal 142, a movement failure of the holder side terminal 142 (for instance, a problem that the holder side terminal 142 is caught and hang over by the holder 141) may occur.

To improve such a problem, a bridge 145 may be provided to a rear surface of the holder side terminal 142 to elastically support both sides of the rear surface of the holder side terminal 142. That is, the bridge 145 is configured to compensate for an eccentric pressure which is generated by pressing one side of the holder side terminal 142.

As shown in FIG. 9, for instance, the bridge 145 includes a support part 145' and a connection part 145".

Referring to the drawing, the structure of the bridge 145 will be described in more detail. The support part 145' is extended in a lengthwise direction on the rear surface of the holder side terminal 142 so as to support both sides of the holder side terminal 142.

In this instance, the support part 145' may be formed to have a shape bent a plurality of times and configured to support both sides of the holder side terminal 142, but not in contact with a central portion of the holder side terminal 142. According to such a configuration and support structure of the support part 145', since a pressure is applied to both ends of the holder side terminal 142 rather than a central portion, an eccentric pressure to the holder side terminal 142 can be more efficiently compensated.

Meanwhile, the elastic member 143, as described before, may be located to correspond to a central portion of the support portion 145'. To fix the elastic member 143, a hook (not shown) may be provided at a central portion of the support part 145'. For reference, the disposition of the elastic member 143 is not limited to the above structure. The elastic member 143 may be disposed at both sides of the support part 145', respectively.

The connection part 145" is extended along the line to cross the lengthwise direction of the support part 145' (in this embodiment, in a vertical direction) and elastically supported by the holder 141. To efficiently compensate for the eccentric pressure of the holder side terminal 142, the connection part 145" is preferably located at a central portion of the support part 145'.

By such a connection structure of the support part 145' and the connection part 145", the bridge 145 forms a substantially 'T' shaped leaf spring.

Meanwhile, when a power is applied via the elastic member 143, since the specific resistance of the elastic member 143 is high, a trouble in an electric connection between the power supply and the holder side terminal 142 may occur.

Specifically, when an applied voltage is low (for instance, a DC power), a current value which is input to the light source 161 may be lowered due to the elastic member 143 which has a high specific resistance. This may influence the brightness of the light emitted from the light source 161 (operated at a weak brightness), or even in a severe case, the light source 161 does not work. That is, when the applied voltage is low, the resistance of the elastic member 143 may deteriorate the electrical connection between the power supply and the light source 161 and influence the brightness of the light source 161.

For reference, when the input voltage is high (for instance, AC power), the above issue may not be a matter.

To improve the above problems, the bridge 145 may be formed of a metallic material to electrically connect the power supply to the holder side terminal 142. That is, the bridge 145, which is configured to compensate for an eccentricity of the holder side terminal 142, may be used as a medium for an electric connection between the power supply and the holder side terminal 142.

For instance, the connection part 145" may be electrically connected to the power supply, and the support part 145' of the bridge 145 may be configured to be in contact with the holder side terminal 145 to transmit a current applied from the power supply to the holder side terminal 142.

For reference, the elastic member 143 is in contact with the bridge 145, but the specific resistance of the elastic member 143 is high so that current does not flow through the elastic member 143. Thus, the elastic member 143 does not influence an electric connection between the power supply and the holder side terminal 142.

Figure 10:
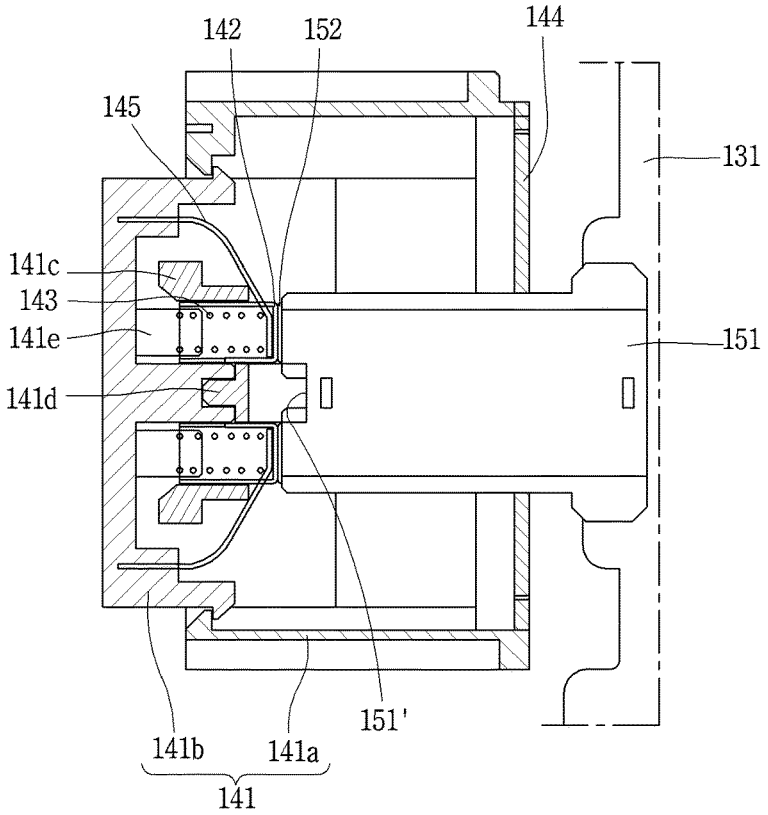
FIG. 10 is a cross-sectional view taken along the line B-B of FIG. 5.
Figure 11:
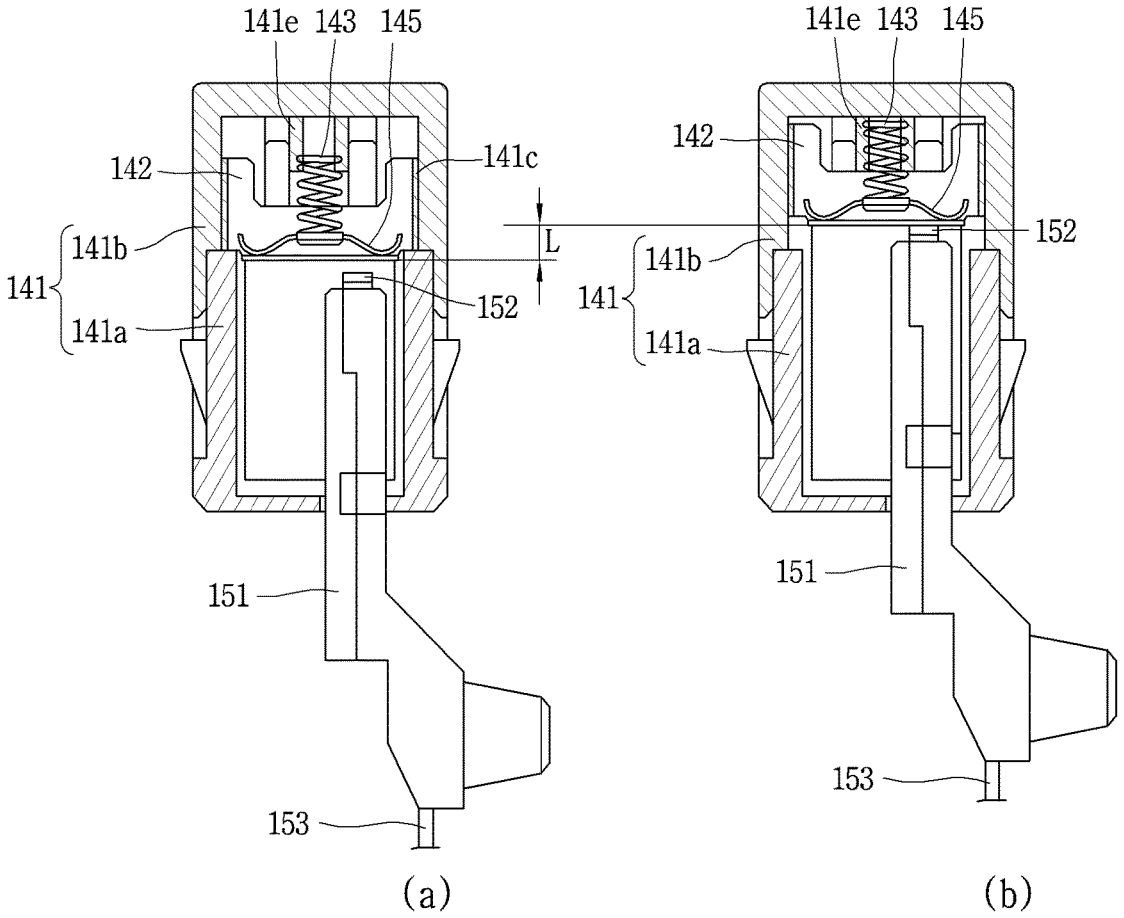
FIGS. 11(*a*) and (*b*) are conceptual views illustrating the states that the shelf terminal unit is in a non-contacting state with the terminal unit (a), and that the shelf terminal unit is in a contact state with the terminal unit (b), respectively.

FIG. 10 is a sectional view taken along the line B-B of FIG. 5, and FIGS. 11(*a*) and (*b*) are conceptual views illustrating the states that the shelf terminal unit is in a non-contacting state with the terminal unit (a), and that the shelf terminal unit is in contact state with the terminal unit (b).

Referring to FIGS. 10 and 11(*a*) and (*b*) with previous drawing FIG. 8, the holder side terminal 142 as described above is configured to correspond to the shelf side terminal 152. In this embodiment, since the shelf side terminal 152 is provided with a first shelf side terminal 152*a* and a second shelf side terminal 152*b* which are disposed at front and rear sides thereof, respectively, the holder side terminal 142 is provided with a first holder side terminal 142*a* corresponding to the first shelf side terminal 152*a* and a second holder side terminal 142*b* corresponding to the second holder side terminal 152*b*.

Thus, the first and second holder side terminals 142*a* and 142*b* are disposed to be spaced apart from each other at front and rear sides at a predetermined interval. Here, the first and second holder side terminals 142*a* and 142*b* may constitute a (+) terminal and a (−) terminal, or vice versa.

In the above configuration, the first and second holder side terminals 142*a* and 142*b* should be electrically separated from each other. For insulation between the first and second holder side terminals 142*a* and 142*b*, the holder 141 may include an insulation jaw 141*d* which is interposed between the first holder side terminal 142*a* and the second holder side terminal 142*b*. In the drawings, it is exemplified shown that the insulation jaw 141*d* is disposed at the holder cover 141*b*.

Meanwhile, the insulation jaw 141*d* is provided at its upper and lower parts with a guide rib 141*c* which is configured to guide inner and outer movements of the first and second holder side terminals 142*a* and 142*b*.

The guide rib 141*c* provided at an upper side of the insulation jaw 141*d* may be disposed to cover upper and both side surfaces of the first holder side terminal 142*a*, and the guide rib 141*c* provided at a lower side of the insulation jaw 141*d* may be disposed to cover lower and both side surfaces of the second holder side terminal 142*b*.

By the above configuration, the first and second holder side terminals 142*a* and 142*b* may be guided in inner and outer directions along the guide rib 141*c* and the insulation jaw 141*d*.

Ends of the first and second holder side terminals 142*a* and 142*b* are formed to protrude from the guide rib 141*c* and the insulation jaw 141*d* so as to be in contact with and to apply a pressure to the first and second shelf side terminals 152*a* and 152*b*.

The shelf terminal unit 150 (strictly, the shelf terminal housing 151) may be configured to be hooked by the insulation jaw 141*d* when the shelf 131 is inserted into the refrigerator main body 110 more than a predetermined depth. Thus, an insertion length of the shelf terminal unit 150 into the holder 141 may be limited, thereby preventing damage of the holder terminal unit 140 due to an excessive insertion of the shelf terminal unit 150.

FIG. 11(*a*) may be understood to show a state that before the holder side terminal 142 is pressed, and FIG. 11 (*b*) may be understood to show a state that the shelf terminal body 151*a* is hooked by the insulation jaw 141*d* by being inserted into the holder 141 at a maximum.

Referring to the above, the holder side terminal 142 may move to inside as much as a maximum moving distance (L), and the maximum moving distance (L) may be appropriately adjusted by the protrusion length of the insulation jaw 141*d*. Also, the maximum moving distance (L) may be appropriately adjusted by the shape of the shelf terminal body 151*a* corresponding to the insulation jaw 141*d*.

Meanwhile, referring to FIG. 10, a groove 151' which is recessed inwardly may be formed between the first shelf side terminal 152*a* and the second shelf side terminal 152*b* of the shelf terminal housing 151, According to the above configuration, though water drops formed by moisture within the refrigerator flows along the first shelf side terminal 152*a*, the water drops are collected within the groove 151', thereby preventing water drops from flowing to the second shelf side terminal 152*b* at a certain level. That is, a short circuit due to an electric conduction between the first shelf side terminal 152*a* and the second shelf side terminal 152*b* may be prevented.

In addition, the recess 151' may be formed at a position opponent to the insulation jaw 141*d* so as to accommodate therein the insulation jaw 141*d*. In this instance, when the shelf terminal housing 151 is inserted into the holder 141 more than a predetermined depth, the insulation jaw 141*d* is inserted into the recess 151' so that the first shelf side terminal 152*a* and the second shelf side terminal 152*b* are located on upper and lower portions of the insulation jaw 141*d*, respectively. That is, a structural barrier according to coupling (accommodating) of the insulation jaw 141*d* to the recess 151' between the first shelf side terminal 152*a* and the second shelf side terminal 152*b*, thereby preventing a short circuit therebetween.

Meanwhile, in a case where the holder side terminal 142 includes the first and second holder side terminals 142*a* and 142*b* which are disposed at upper and lower sides, bridges 145*a* and 145*b* corresponding to the first and second holder side terminals 142*a* and 142*b*, respectively, may be installed as below.

The bridge 145 is configured to correspond to the holder side terminal 142. That is, the bridge 145 includes a first bridge 145*a* corresponding to the first holder side terminal 142*a* and a second bridge 145*b* corresponding to the second holder side terminal 142*b*.

A connection part 145" of the first bridge 145*a* may be extended upwardly and a connection part 145" of the second bridge 145*b* may be extended downwardly. Here, the first and second bridges 145*a* and 145*b* are different in their installation direction, but may be formed in the same shape as the bridge 145, as described above.

According to the above configuration, an eccentric pressure applied to each holder side terminal 142*a* or 142*b* may be efficiently compensated for, without any structural interference of one holder side terminal 142*a* or 142*b* to another.

Meanwhile, referring to preceding drawings (FIGS. 5 and 6), a cable 146 may be connected to the bridge 145. The cable 146 is electrically connected to the power supply and supplies a power to the holder side terminal 142 through the bridge 145. The cable 146 may be coupled to a forcibly contacting blade formed in the type of grove at the bridge 145 in a forcibly contacting manner, and the holder cover 141*b* may be coupled to the holder body 141*a* to cover the cable 146 fixed to the bridge 145.

The cable 146 may include two cables 146 which are connected to each bridge 145 constituting (+) and (−) terminals. In this instance, the forcible contacting blade of each bridges 145*a* and 145*b* may be disposed to be spaced apart from each other in a widthwise direction. In such a configuration that plural holder terminals 140 are disposed to be spaced apart from each other in a lengthwise direction of the frame 170, the two cables 146 can be connected without any interference therebetween in the lengthwise direction, thereby enhancing the assembling convenience.

Figure 12A:
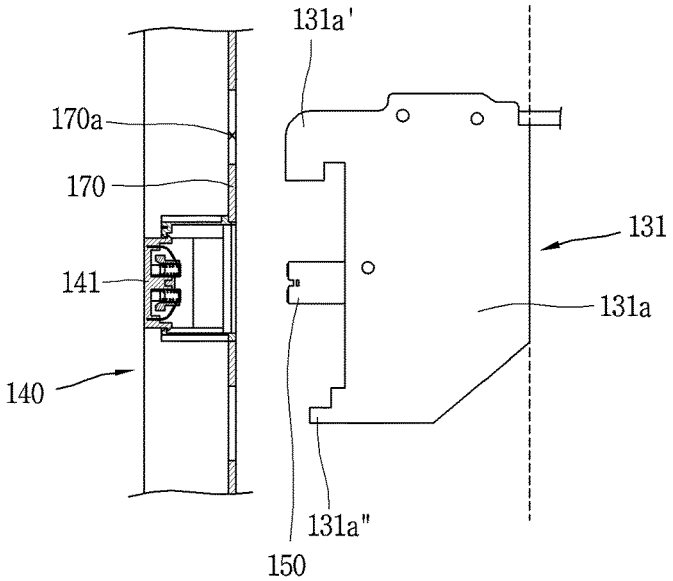
FIGS. 12*a* through 12*c* are conceptual views illustrating a coupling procedure between the shelf terminal unit and the holder terminal unit.
Figure 12B:
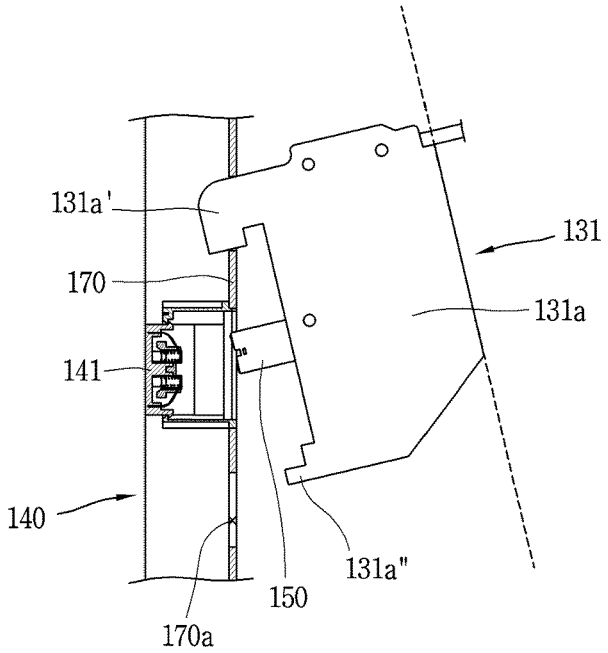
Figure 12C:
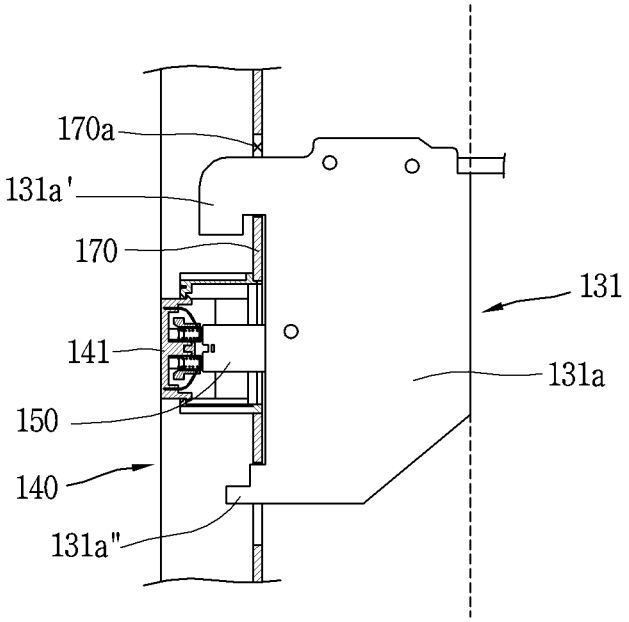

FIGS. 12*a* through 12*c* are conceptual views illustrating a coupling procedure between the shelf terminal unit 150 and the holder terminal unit 140.

Referring to those drawings, a frame 170 is disposed on an inner rear wall 114 of the refrigerator main body 110, and a plurality of openings 170*a* are provided on the frame 170 in upper and lower directions. The plurality of openings 170*a* is provided in correspondence to the installation positions of the shelf 131.

At least one holder terminal unit 140 may be provided within the frame 170, and a front opening 140' of the holder terminal unit 140 may be disposed between the plurality of openings 170*a*. Here, as described above, the cover 144 is disposed so as to cover the front opening 141' of the holder terminal unit 140.

Meanwhile, the shelf 131 is provided with a hook part 131*a*' which is configured to be inserted into one of the plurality of openings 170*a* and hooked to the frame 170. The hook part 131*a*' is formed at an upper part of the shelf 131, and may have a shape bent downwardly.

A holder terminal unit 140 is provided at a lower portion of the opening 170*a* in which the hook part 131*a*' is inserted, and the shelf terminal unit 150 is configured to contact the holder terminal unit 140 when the shelf 131 is installed to the frame 170.

Specifically, as shown in FIG. 12*b*, when the hook part 131*a*' is started to be inserted into one of the plurality of openings 170*a* in a state that the shelf 131 is tilted at a predetermined angle, the shelf terminal unit 150, which is provided at a lower portion of the hook part 131*a*', is located to correspond to the holder terminal unit 140. As the hook part 131*a*' is gradually inserted into the opening 170*a*, the shelf terminal unit 150 is inserted into the holder 141 after passing the cutout portions 144*a*, 144*b* and 144*c* of the cover 144.

Thereafter, as shown in FIG. 12*c*, when the hook part 131*a*' inserted into the opening 170*a* is hooked by the frame 170, at least part of the shelf terminal unit 150 is inserted into the opening 141' and the shelf side terminal 152 is in contact with the holder side terminal 142 with a pressure. That is, an electrical connection between the shelf side terminal 152 and the holder side terminal 142 is performed so that the power is applied to the light source 161 provided at the shelf 131.

In this instance, an insertion part 131*a*" may be provided at a lower portion of the shelf terminal unit 150 so as to be inserted into one of the plurality of openings 170*a*. The insertion part 131*a*" plays a role to fix the shelf 131 to the frame 170 together with the hook part 131*a'*.

According to such a configuration, the shelf terminal unit 150 is located between the hook part 131*a*' and the insertion part 131*a*". However, the present disclosure is not limited thereto. The fixture structure of the shelf 131 and the electrical connection structure of the shelf 131 may be variously modified.

Hereinafter, another embodiment of the power supply module according to the present disclosure will be described.

Unless otherwise specified, the structures of the power supply module described hereinafter may be equally applied to those as described hereinbefore.

Figure 13:
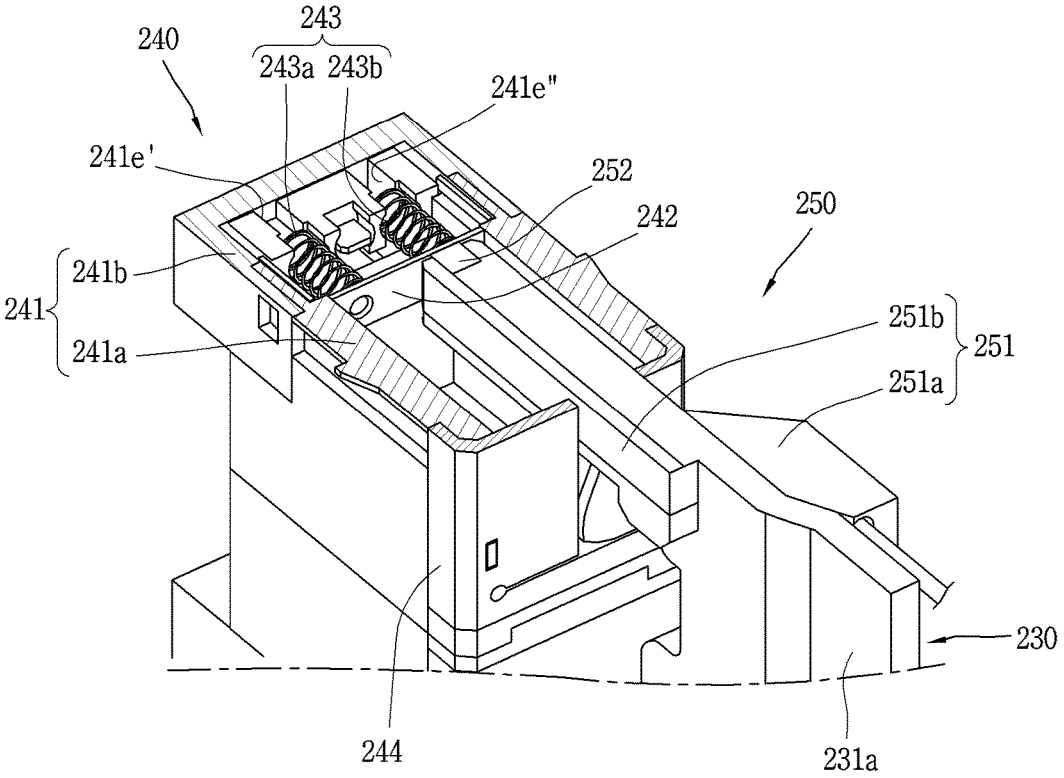
FIG. 13 is a conceptual view illustrating the power supply module according to another embodiment of the present disclosure.
Figure 14:
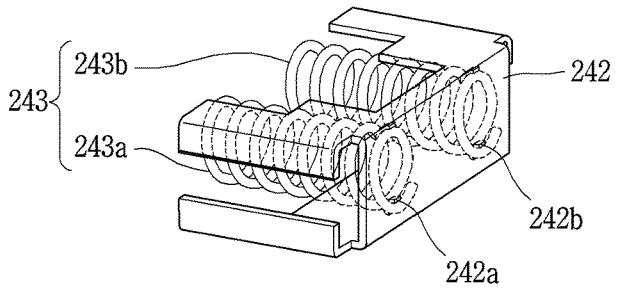
FIG. 14 is a conceptual view illustrating main elements of the holder terminal unit of FIG. 13.

FIG. 13 is a conceptual view illustrating the power supply module according to another embodiment of the present disclosure, and FIG. 14 is a conceptual view illustrating main elements of the holder terminal unit 240 of FIG. 13.

In the preceding embodiment, a separate member such as the bridge 145 has been used to compensate for an eccentric pressure which is generated on account of pressing one side of the holder side terminal 142. However, in this embodiment, a new structure is proposed to improve a movement failure of the holder side terminal 242 due to an eccentric pressure, without the bridge 145.

To this end, an elastic member 243 is disposed at both sides of the holder side terminal 242, respectively, to compensate for an eccentric pressure. That is, the elastic member 243 includes a first spring 243*a* and a second spring 243*b* which are disposed at both sides of the holder side terminal 242.

Structurally, the first spring 243*a* may be supported by one rear surface of the holder side terminal 242 and an inner wall of the holder 241, respectively, and the second spring 243*b* may be supported by the other rear surface of the holder side terminal 242 and the inner wall of the holder 241, respectively. For reference, the first and second springs 243*a* and 243*b* may be two springs which have the same size, shape and physical properties, but disposed at different positions.

Meanwhile, the holder 241 may include a first spring accommodation part 241*e*' and a second spring accommodation part 241*e*", which are configured to accommodate therein each end of the first and second springs 243*a* and 243*b* and to fix the locations thereof. In FIG. 13, it is exemplified shown that the first and second spring accommodation parts 241*e*' and 241*e*" are formed at left and right sides of the holder cover 241*b*, respectively.

In addition, at an inner side of the holder side terminal 242 to which each end of the first and second springs 243*a* and 243*b* is supported, first and second spring fixing parts 242*a* and 242*b* for fixing another end of the first and second springs 243*a* and 243*b* may be provided, respectively. In FIG. 14, it is exemplified shown that the first and second spring fixing parts 242*a* and 242*b* are formed in a hook type so as to be hooked to the other ends of the first and second springs 243*a* and 243*b*.

Figure 15:
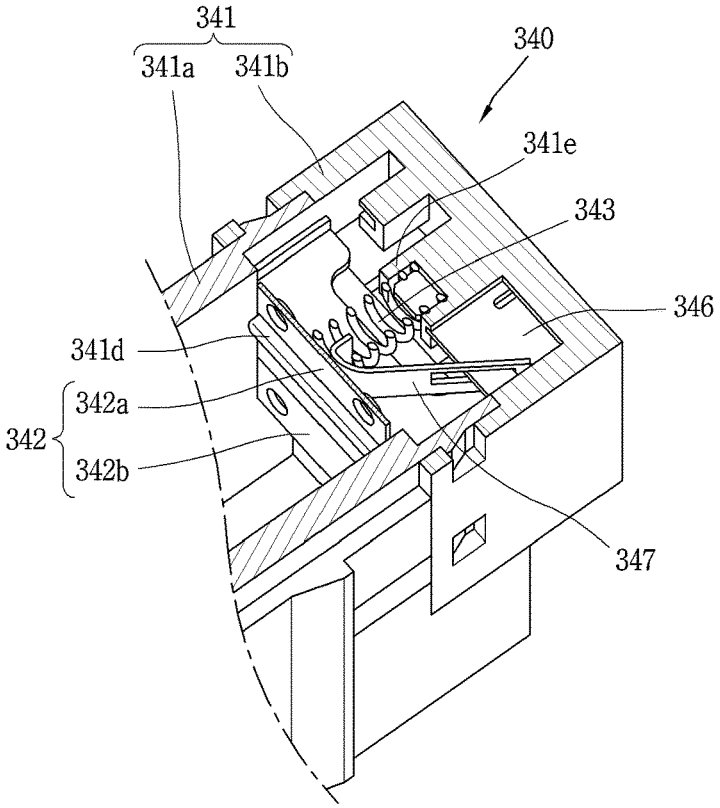
FIG. 15 is a conceptual view illustrating the power supply module according to a still another embodiment of the present disclosure.
Figure 16:
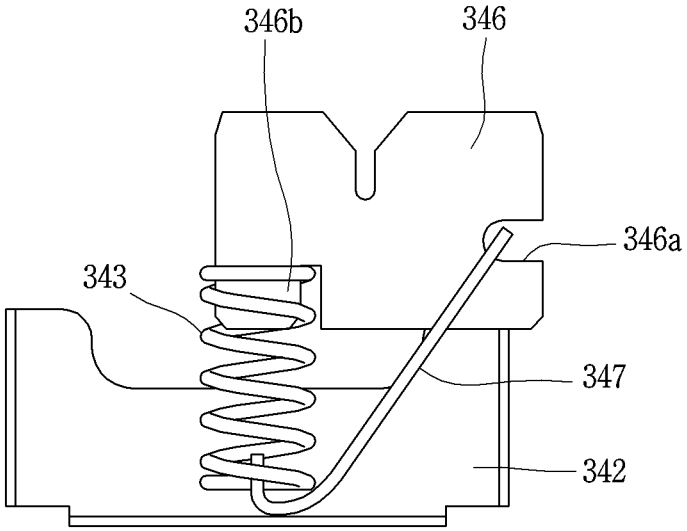
FIG. 16 is a conceptual view illustrating main elements of the holder terminal unit of FIG. 15.

FIG. 15 is a conceptual view illustrating the power supply module according to a still another embodiment of the present disclosure, and FIG. 16 is a conceptual view illustrating main elements of the holder terminal unit 340 of FIG. 15.

This embodiment is proposed to improve a movement failure of the holder side terminal 342 by an eccentric pressure and a contact resistance problem when applying a power through a compression spring.

Referring to FIGS. 15 and 16, the holder terminal unit 340 is configured to be electrically connected to the power supply and the shelf 131 when installation of the shelf 131 within the refrigerator main body 110 is completed.

The holder terminal unit 340 includes a holder 341, a holder side terminal 342, an elastic member 343, a cover (not shown), a power supply terminal 346, and a connection member 347. Among the above elements, descriptions of the elements except the power supply terminal 346 and the connection member 347 will be replaced by those as described with reference to the previous ones.

The power supply terminal 346 is mounted to the holder 341, and electrically connected to the power supply. In this embodiment, it is exemplified shown that the power supply terminal 346 is mounted to the holder cover 341*b*.

The connection member 347 is configured to be connected to the power supply terminal 346 and elastically support a rear surface of the holder side terminal 342. The connection member 347 is formed of a metallic material and configured to electrically connect the power supply terminal 346 to the holder side terminal 342. In this embodiment, the connection member 347 is shown to be formed of a leaf spring.

That is, the connection member 347 is configured to elastically support a rear surface of the holder side terminal 342, while electrically connecting the power supply terminal 346 to the holder side terminal 342, to compensate for an eccentricity at a certain degree.

To more specifically describe the structure of the present embodiment, the power supply terminal 346 is provided with a connection member accommodation groove 346*a* and an elastic member accommodation groove 346*b*, respectively.

One end of the connection member 347 is hooked by the connection member accommodation groove 346*a* and another end thereof is configured to elastically support a central portion of the rear surface of the holder side terminal 342. By such a configuration, the connection member 347 may be disposed in a slanted manner toward one side.

One end of the elastic member 343 is inserted into and fixed to the elastic member accommodation groove 346*b*, and the holder 341 may include an elastic member accommodation part 341*e* which accommodates therein one end of the elastic member 343. Further, another end of the elastic member 343 is inserted into and fixed to another end of the connection part 345*b* which is located at a central portion of a rear surface of the holder side terminal 342.

Thus, the elastic member 343 may be supported by another end of the connection member 347 which elastically supports a rear surface of the holder side terminal 342 and the power supply terminal 346, respectively. In this instance, the elastic member 343 may be positioned at a central portion of the holder side terminal 342.

Meanwhile, the connection member 347 may be formed of a metallic material, and configured to electrically connect the power terminal 346 to the holder side terminal 342. That is, the connection member 347 for compensating for an eccentricity of the holder side terminal 346 may be used as a medium for an electrical connection between the power supply terminal 346 and the holder side terminal 342.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

The invention claimed is:

1. A refrigerator comprising:

a holder terminal unit provided in a main body of the refrigerator; and a shelf terminal unit provided in a shelf installed in the main body, wherein the holder terminal unit includes:

a holder installed at an inner rear wall of the refrigerator main body and having an opening which is opened toward a front side of the refrigerator;

a holder side terminal provided to correspond to a shelf side terminal of the shelf terminal unit and provided to be movable in forward and backward directions within the holder, wherein the shelf side terminal includes a first shelf side terminal at an upper side of the shelf side terminal and a second shelf side terminal at a lower side of the shelf side terminal, and wherein the holder side terminal includes a first holder side terminal corresponding to the first shelf side terminal and a second holder side terminal corresponding to the second shelf side holder; and an elastic member provided between the holder and the holder side terminal and configured to elastically support the holder side terminal, wherein the holder side terminal is pressurized by the shelf side terminal which is inserted into the holder through the opening and moved rearwardly when the shelf is installed to the refrigerator main body, while maintaining an elastic contact with the shelf side terminal by the elastic member, and wherein the holder includes an insulation jaw disposed between the first holder side terminal and the second holder side terminal for insulation therebetween.

2. The refrigerator of claim 1, wherein the holder terminal unit is provided at the inner rear wall of the refrigerator main body so that the holder side terminal faces a front side, and wherein the shelf side terminal is provided at a rear side of the shelf which faces the rear wall so as to face the holder side terminal.

3. The refrigerator of claim 1, wherein a pair of guide ribs are extended in front and rear directions at both inner sides of the holder, and wherein the holder side terminal is accommodated between the guide ribs so as to be guided in the front and rear directions.

4. The refrigerator of claim 1, wherein the holder terminal unit is mounted to the holder so as to cover the opening, and further includes a cover having a cutout portion through which the shelf side terminal passes.

5. The refrigerator of claim 4, wherein the cutout portion includes:

a main cutout portion which is cutout vertically in a lengthwise direction of the cover; and a first sub-cutout portion and a second sub-cutout portion each provided at both ends of the main cutout portion and extended toward both sides of the main cutout portion.

6. The refrigerator of claim 1, wherein the holder terminal unit further includes a bridge configured to elastically support both sides of a rear surface of the holder side terminal to compensate for an eccentric pressure generated by pressing one side of the holder side terminal.

7. The refrigerator of claim 6, wherein the bridge is formed of a metallic material and configured to electrically connect a power supply unit to the holder side terminal.

8. The refrigerator of claim 7, wherein the bridge includes:

a support part extended from a rear surface of the holder side terminal in a lengthwise direction and configured to support both sides of the holder side terminal; and a connection part extended in a crossing direction of the lengthwise direction and elastically supported by the holder, and electrically connected to the power supply unit.

9. The refrigerator of claim 8, wherein the support part is formed to be bent plural times to support both ends of the holder side terminal without contacting a central portion of the holder side terminal, and wherein the elastic member is located at a central portion of the support part.

10. The refrigerator of claim 1, wherein the shelf terminal unit further includes a shelf terminal housing, to which first and second shelf side terminals are mounted, respectively, disposed at a rear side of the shelf, and wherein the shelf terminal housing is hooked by the insulation jaw when the shelf is inserted into the refrigerator main body more than a predetermined depth.

11. The refrigerator of claim 1, wherein the holder terminal unit further includes a bridge including a support part extended in a lengthwise direction on a rear surface of the holder side terminal and configured to support both sides of the holder side terminal, and a connection part extended to cross the lengthwise direction from the support part so as to be elastically supported by the holder and electrically connected to a power supply unit, and wherein the bridge includes a first bridge corresponding to the first holder side terminal provided at an upper side; and a second bridge corresponding to the second holder side terminal provided at a lower side, and wherein the connection part of the first bridge is upwardly extended, and the connection part of the second bridge is downwardly extended.

12. The refrigerator of claim 1, wherein the holder terminal unit further includes:

a power supply terminal electrically connected to a power supply unit; and a connection member connected to the power supply terminal and configured to elastically support a rear surface of the holder side terminal, and formed of a metallic material to electrically connect the power supply terminal to the holder side terminal.

13. The refrigerator of claim 12, wherein the elastic member is connected to one end of the connection member which elastically supports a rear surface of the holder side terminal and the power supply terminal, respectively.

14. A refrigerator comprising:

a holder terminal unit provided in a main body of the refrigerator; and a shelf terminal unit provided in a shelf installed in the main body, wherein the holder terminal unit includes:

a holder installed at an inner rear wall of the refrigerator main body and having an opening which is opened toward a front side of the refrigerator;

a holder side terminal provided to correspond to a shelf side terminal of the shelf terminal unit and provided to be movable in forward and backward directions within the holder;

an elastic member provided between the holder and the holder side terminal and configured to elastically support the holder side terminal; and a bridge (i) configured to elastically support both sides of a rear surface of the holder side terminal to compensate for an eccentric pressure generated by pressing one side of the holder side terminal, (ii) formed of a metallic material and configured to electrically connect the power supply unit to the holder side terminal, and (iii) including (a) a support part extended from a rear surface of the holder side terminal in a lengthwise direction and configured to support both sides of the holder side terminal and (b) a connection part extended in a crossing direction of the lengthwise direction and elastically supported by the holder, and electrically connected to a power supply unit, wherein the holder side terminal is pressurized by the shelf side terminal which is inserted into the holder through the opening and moved rearwardly when the shelf is installed to the refrigerator main body, while maintaining an elastic contact with the shelf side terminal by the elastic member.

15. The refrigerator of claim 14, wherein the support part is formed to be bent plural times to support both ends of the holder side terminal without contacting a central portion of the holder side terminal, and wherein the elastic member is located at a central portion of the support part.

16. The refrigerator of claim 14, wherein the holder terminal unit is provided at the inner rear wall of the refrigerator main body so that the holder side terminal faces a front side, and wherein the shelf side terminal is provided at a rear side of the shelf which faces the rear wall so as to face the holder side terminal.

17. The refrigerator of claim 14, wherein a pair of guide ribs are extended in front and rear directions at both inner sides of the holder, and wherein the holder side terminal is accommodated between the guide ribs so as to be guided in the front and rear directions.

18. The refrigerator of claim 14, wherein the holder terminal unit further includes a cover mounted to the holder so as to cover the opening, and having a cutout portion through which the shelf side terminal passes.

19. The refrigerator of claim 18, wherein the cutout portion includes:

a main cutout portion which is cutout vertically in a lengthwise direction of the cover; and a first sub-cutout portion and a second sub-cutout portion each provided at both ends of the main cutout portion and extended toward both sides of the main cutout portion.

* * * * *